US005522597A

United States Patent [19]

Hanks

[11] Patent Number: 5,522,597

[45] Date of Patent: Jun. 4, 1996

[54] GAME APPARATUS

[76] Inventor: Richard C. Hanks, 2495 G.A.R. Hwy., Swansea, Mass. 02777

[21] Appl. No.: 503,181

[22] Filed: Jul. 17, 1995

[51] Int. Cl.[6] ..... A63B 65/00

[52] U.S. Cl. ..... 273/327; 273/343; 273/412

[58] Field of Search ..... 273/327, 343, 273/412, 413, 426, 428

[56] References Cited

U.S. PATENT DOCUMENTS

| | | | |
|---|---|---|---|
| 442,675 | 12/1890 | Wilcox | 273/327 |
| 2,120,075 | 6/1938 | Roosman | 273/327 |
| 2,127,433 | 8/1938 | Sky | 273/327 |
| 2,436,174 | 2/1948 | Myers | 273/327 X |
| 2,797,924 | 7/1957 | Stewart | 273/343 |
| 3,049,352 | 8/1962 | Hancock | 273/327 |
| 3,701,531 | 10/1972 | Bowers | 273/343 |
| 3,717,348 | 2/1973 | Bowers | 273/327 |
| 5,375,848 | 12/1994 | Coleman | 273/327 |
| 5,377,995 | 1/1995 | Clark | 273/327 |

*Primary Examiner*—William H. Grieb
*Attorney, Agent, or Firm*—Robert J. Doherty

[57] ABSTRACT

A game apparatus including a dual-bodied missile member which consists of two elements connected to each other by a flexible cord portion and a tossing/catching implement or stick member which is used in launching and receiving the missile. At least one rest or missile support ledge is provided along the longitudinal shaft portion of the tossing/catching implement to position the missile on the shaft for overhead tossing therefrom.

10 Claims, 5 Drawing Sheets

GAME APPARATUS

BACKGROUND AND OBJECTS OF THE INVENTION

This invention relates to a game apparatus and more particularly to an improved apparatus for tossing and catching a missile member such as a pair of balls connected by a flexible cord as well as to the construction of such missile and the implement by which it is tossed and caught.

Game apparatus in which a stick or other implement is used to sequentially toss and catch a missile in the form of a pair of balls connected by a flexible cord are relatively well known and include the examples pictured in the following U.S. patents: U.S. Pat. No. 2,120,075 issued Jun. 7, 1938 to Roosman; U.S. Pat. No. 3,049,352 to Hancock issued Aug. 14, 1962; U.S. Pat. No. 5,375,848 issued Dec. 27, 1994 to Coleman; and U.S. Pat. No. 5,377,995 issued Jan. 3, 1995 to Clarke. While suitable for the intended purposes, the devices set forth in these patents are particularly adapted for a rather sedate, slow moving type of game action in which the missiles are tossed by the stick with an underhand motion. This is particularly true in regard to the devices shown by the Clarke and Hancock patents.

A more desirable form of play, however which is more in tune with today's fast action and athletic interest is one in which the stick or tossing/catching implement can be used more easily in an overhand fashion by the game participants who are normally young men and women or children such that greater elevation and distance can be imparted to the missile member thus increasing the interest, athleticism, and conditioning effects of the game as well as heightening its play value and speed. Accordingly, the primary object of the present invention is to present such a game apparatus which is particularly adapted for use for such overhead tossing techniques and a high speed athletic type of game. These and other objects of the present invention are accomplished by a game apparatus comprising a dual-bodied missile member comprising two body elements connected to each other by a flexible elongated connecting portion and a tossing/catching implement to toss and catch said missile member, said implement being a stick including an elongated body having a grasping portion at one end, and a toss/catch portion at the other end thereof, said body toss/catch portion being a shaft with upper and lower ends and having an overall elongated generally cylindrical outer surface and connected to the grasping portion at its lower end and terminating at its upper end in an unobstructed terminus with a smooth outer surface such that the elongated connecting portion can slip off the shaft at such terminus without impediment and said shaft having at least one annular outwardly generally radially extending ledge portion formed intermediate said upper and lower shaft ends, said ledge portion forming a rest for supporting said elongated connecting portion of said missile member on said shaft prior to its toss therefrom.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
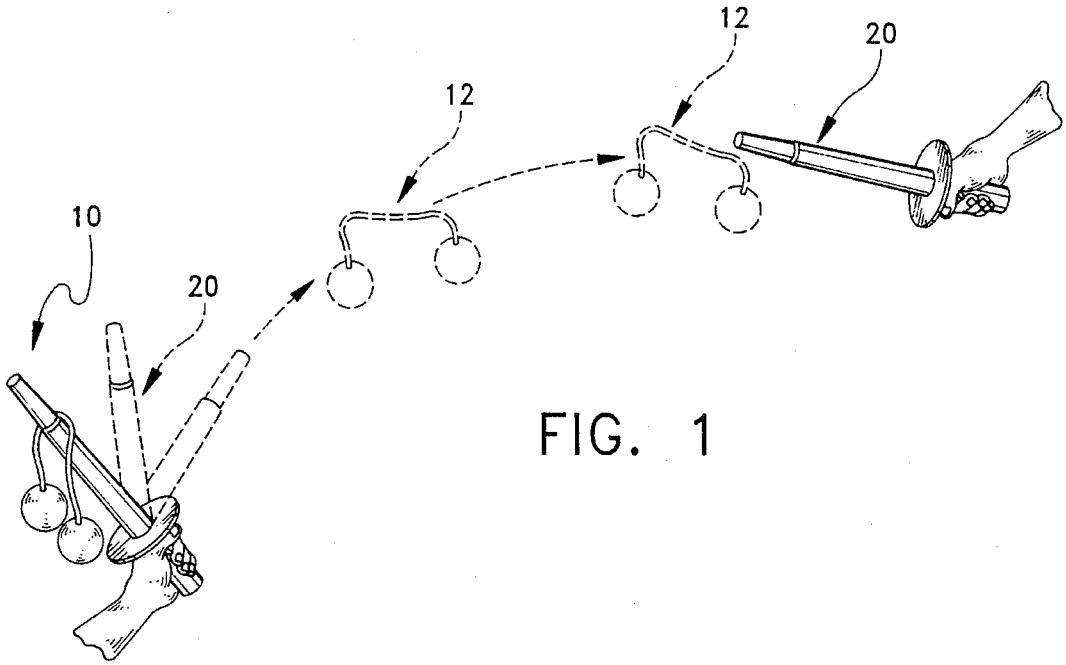
FIG. 1 is a partial perspective view showing the manner in which the stick-like implement of the present invention can be utilized to alternately toss and catch the missile member of the present invention.

Turning now to the drawings and particularly FIGS. 1 through 6, one embodiment of the device of the present invention is depicted. The game apparatus 10 comprises a dual-bodied missile member 12 comprising two body elements 14 generally in the form of spherical implements such as tennis balls 14 connected to each other by a short length of a flexible cord 16. The balls 14 are connected to opposite ends of the flexible cord 16 by any known means including forcing enlarged or knotted terminal portions (not shown) of the cord 16 through an opening 18 provided in each of the balls 14. The cord 16 may be of rope or an elongated flexible plastic shaft or alternatively can be made from wire or other materials so long as it is at least somewhat flexible and preferably resist abrasion and serves to connect the two body elements or balls 14 together such when they are thrust into the air as will be hereinafter more fully described they tend to spin, rotate and tumble in a desired play enhanced style.

The tossing/catching implement 20 is of overall elongated form and includes a grasping portion or handle 22 at one end thereof and connecting with a generally cylindrical shaft 24 which may be a continuation of the handle portion 22. The shaft 24 preferably is cylindrical in cross section and tapers from an enlarged lower end 26 to a reduced diameter upper end 28. It is preferred that such taper be gradual such that the progressive movement of the missile member and particularly the cord portion 16 thereof which contacts the outer surface 30 of the shaft may smoothly be released by the overhand tossing action contemplated by the present game and thus progressively move from a resting point intermediate the longitudinal length of the shaft 24 towards and finally from the upper terminal end 28 thereof. It should be brought out that while the preferable configuration of the shaft 24 is circular other annular forms may be provided such as oval and the like so long as the overall game objectives are not hampered by such.

Figure 5:
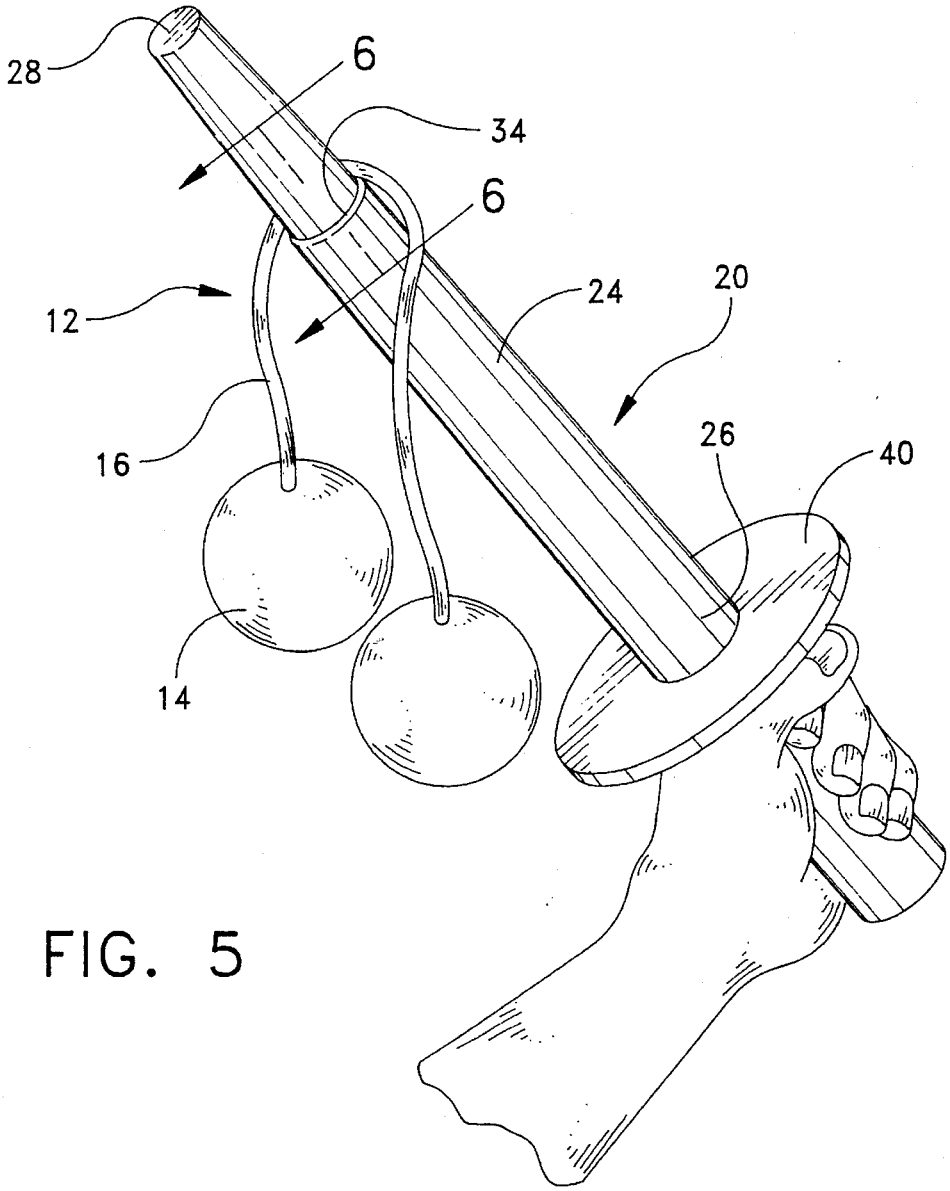
FIG. 5 is a perspective view showing the manner in which the cord portion of the missile member is received by the stick implement prior to being tossed therefrom.
Figure 6:
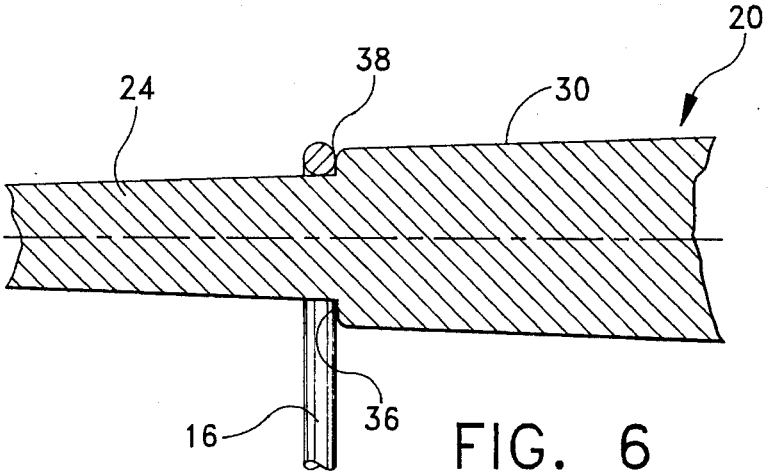
FIG. 6 is a sectional view along the line 6—6 of FIG. 5.

Also, it should be noted that at least one radially outwardly extending ledge 34 is provided intermediate the ends 26 and 28 of the shaft 24 for temporary receipt and support of the cord member 16 as best shown in FIG. 5. Such ledge or stop 34 includes a relatively flat surface 36 which generally radially outwardly extends normally, that is, at an approximate 90 degree angle, from the overall surface 30 of the shaft 24 and may be provided with rounded corners 38 or other configurations dictated by practicality or manufacturing needs. The essential point is that the ledge or support 34 provides an area intermediate of the length of the shaft 24 where the missile member may be supported and rest preliminarily to being launched or tossed by the implement 20. Obviously if no such ledge were provided, it would be difficult to launch the missile member 12 from any specific position except that proximate where the user's hand was placed or proximate to the flange 40 utilized to isolate the user's hand from the remaining portions of the member 20 and particularly the shaft portion 24. Alternatively without the ledge incorporation it would be possible to hold the shaft in a horizontal position thus to achieve various launching positions but that would limit the game and its flexibility since one of the desirable features of the present invention is to be able to position the missile member 12 at various positions along the shaft so as to regulate the distance it will have to move from its rest position to the terminal end 28 and thus the resultant moment arm which is afforded by the tossing action. In this way then, greater flexibility, interest, height, distance and control can be imparted to the missile member of the present invention in the intended fashion. Thus when the cord is suspended proximate the end of the shaft 24 as is shown in the single ledge 34 provided in the FIGS. 1 through 5 showings, a greater moment arm is achieved by the tossing force and thus a higher force imparted to the missile.

Figure 7:
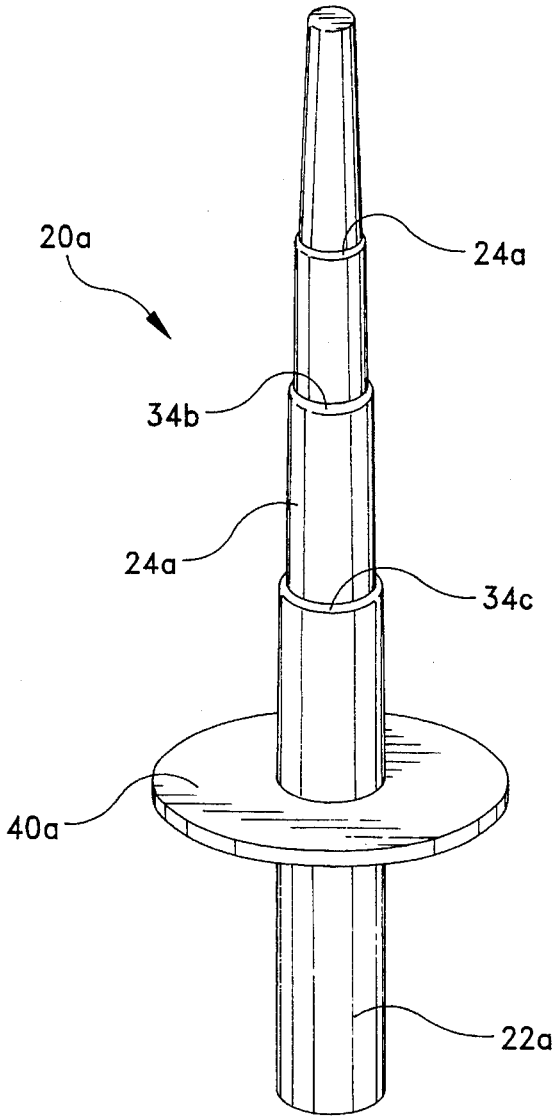
FIG. 7 is a perspective view of another form in which the tossing/catching implement may take wherein a plurality of supporting ledges for the cord member of the missile member are provided.

In an alternate embodiment of the invention as shown by FIG. 7, a plurality of ledges 34*a*, 34*b* and 34*c* are shown in progressive longitudinally separated positions along the extent of the shaft 24*a*. In this manner then further launch positions of the missile 12 can be achieved by utilizing such modified structure. As a specific example, the implement 20 can be about 30 inches long of which 12 inches comprises the handle so either one or both hands can be used for gripping. The missile members are connected by a 15 inch cord, e.g., ¼ inch shock-type cord. The implement 20 can be made from any suitable material including metal, wood, plastic or graphite.

Figure 8:
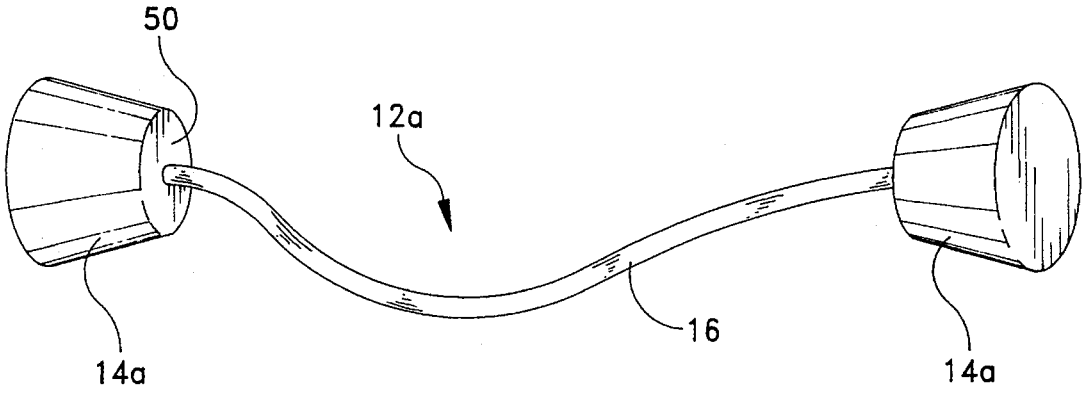
FIG. 8 is a perspective view of an alternate form of the missile member in which instead of utilizing body elements which are spherical in shape, the body elements are frusto conical or otherwise provided with an upper relatively flat surface which is adapted to come in contact with and be utilized for enabling the missile to be tossed when supported by such surface rather than the cord portion thereof.
Figure 9:
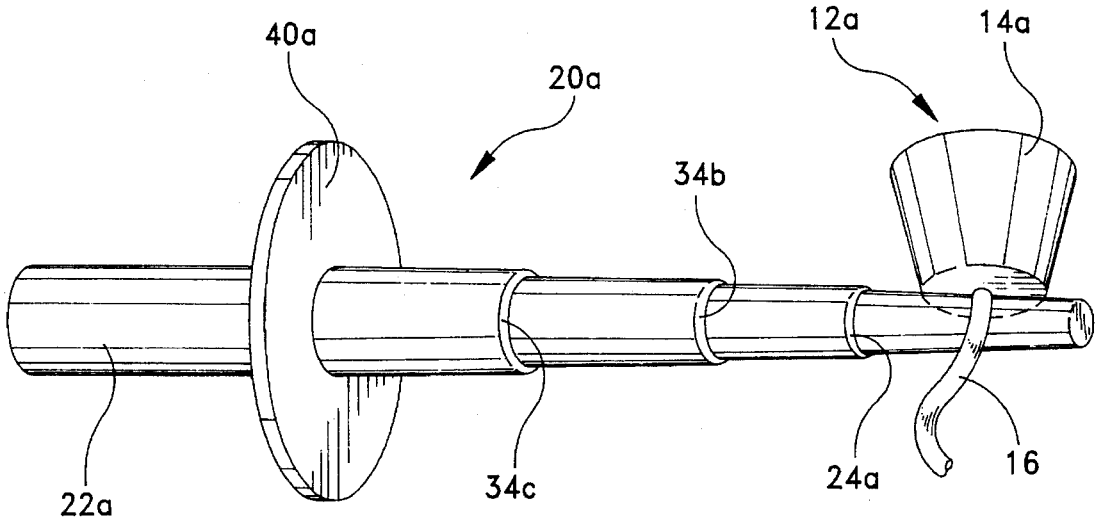
FIG. 9 is a partial sectional view showing the manner in which the tossing/catching implement may contact the flat top surface of one of the body elements shown in the FIG. 8 alternate embodiment.

Turning now to FIGS. 8 and 9 of the drawings, a modified form of the missile member 12*a* is shown. Therein a cord 16 is utilized to connect two frusto conically shaped body elements 14*a* to each other. Of particular interest in such elements 14*a* is the provision of an upper relatively flat surface 50. Such support surface 50 can be utilized to suspend the missile member 12*a* from the shaft 20 or 20*a* and thus be utilized to impart tumbling or other fun type motions to the implement upon its being tossed. Normally, however, the alternate embodiment implement 12*a* would be caught in the same fashion, that is, by contact with the cord 16 which in most instances if flexible enough tends to initially at least wrap around the shaft 24 or 24*a* dependent on which tossing implement is utilized. In the normal form of the game, the implement is tossed back and forth between participants, e.g., one participant catches the missile member with the hand held tossing/catching implement and then rearranges such to the desired launch position dependent on which embodiment utilized and then tosses it back to the other participant. Either of the body elements 14, 14*a* can be of hollow or solid construction although for elements 14, tennis balls are suitable.

Figure 2:
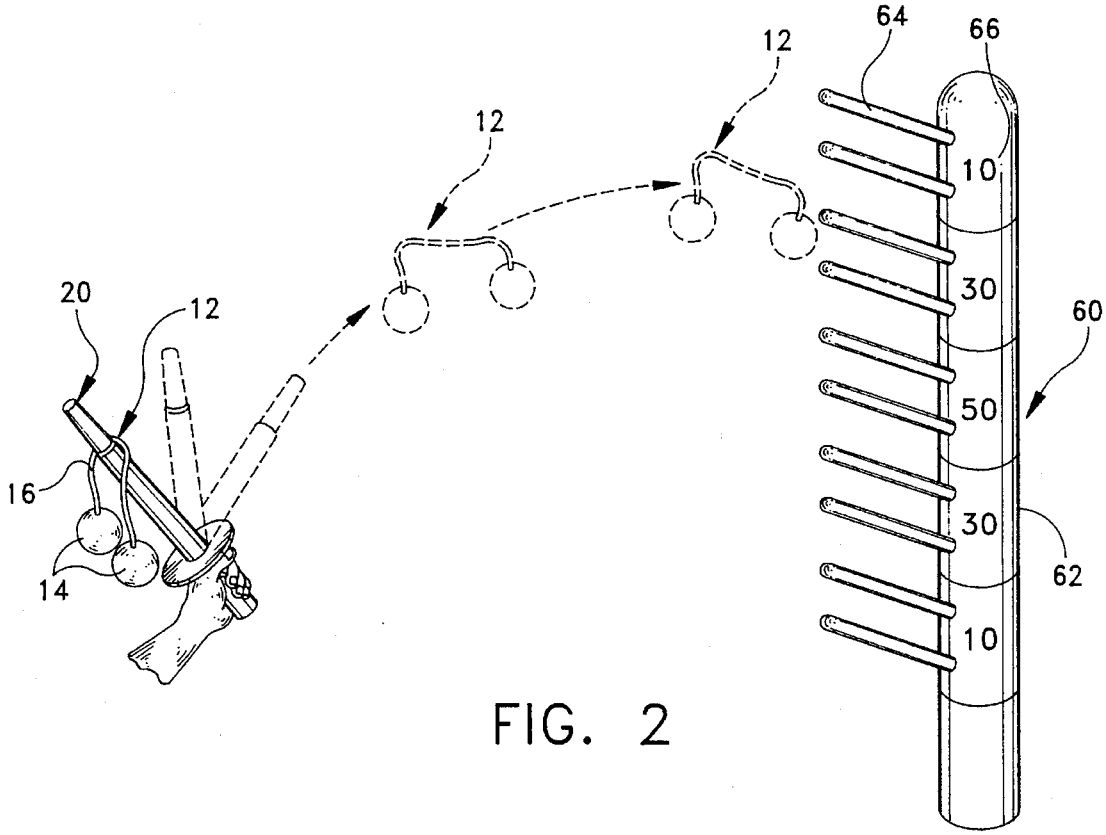
FIG. 2 is a view similar to FIG. 1 but showing an alternate embodiment in which the missile is not retrieved by another game participant but where one of the game participants is substituted by a target including an upright post with pegs such that varied scores can be achieved dependent on the position on which the missile element is suspended.
Figure 3:
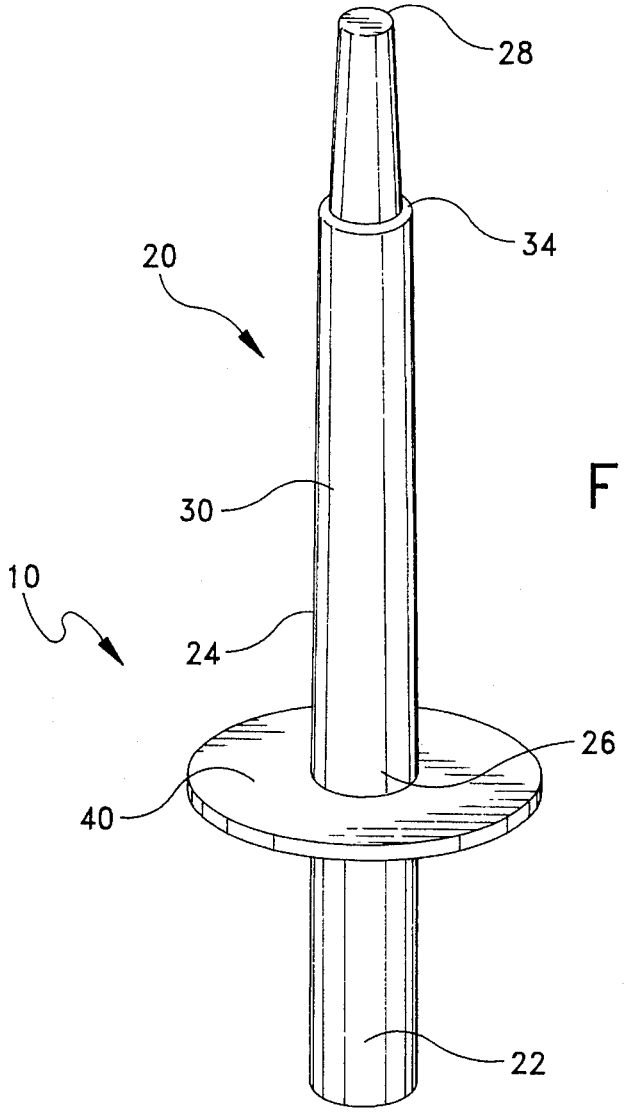
FIG. 3 is an enlarged perspective view of one of the tossing/catching implements of the present invention.
Figure 4:
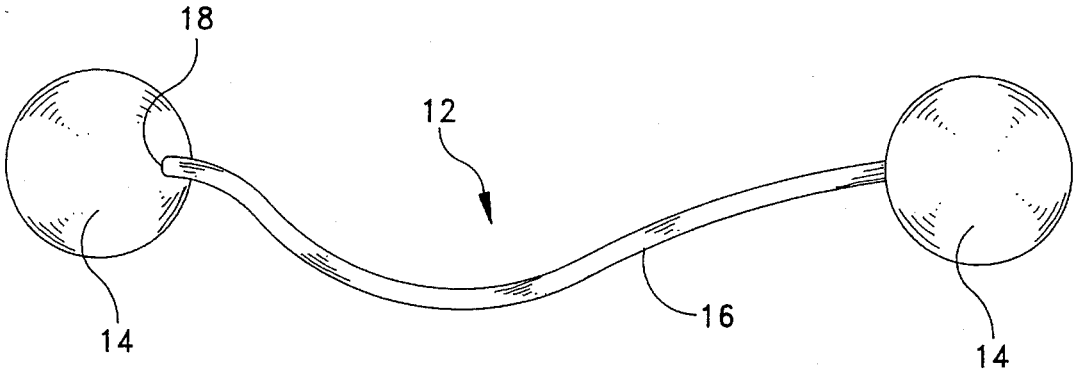
FIG. 4 is an enlarged perspective view showing the missile member.

By utilizing the launch or toss implement of the present invention, the choice between underhand, side arm and overhand tossing is not restricted as with previous devices and thus a fuller and more fast action game can be achieved if desired. Also and as shown in FIGS. 2, the play action need not be between live participants, but a single participant can utilize the game apparatus of the present invention to toss the missile member either 12 or 12*a* onto a scoring target 60. In the case shown in FIG. 2, such scoring target 60 includes a post 62 having a plurality of vertically spaced pegs 64 connected thereto and associated with varying scoring values dependent upon their spacial relationship to the overall extent of the post and thus various scores can be achieved as indicated by the indicia 66 provided thereof. It should be brought out that other targets and scoring devices could also be utilized.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game apparatus comprising a dual-bodied missile member comprising two body elements connected to each other by a flexible elongated connecting portion and a tossing/catching implement to toss and catch said missile member, said implement being a stick including an elongated body having a grasping portion at one end, and a toss/catch portion at the other end thereof, said body toss/catch portion being a shaft with upper and lower ends and having an overall elongated generally cylindrical outer surface and connected to the grasping portion at its lower end and terminating at its upper end in an unobstructed terminus with a smooth outer surface such that the elongated connecting portion can slip off the shaft at such terminus without impediment and said shaft having at least one annular outwardly generally radially extending ledge portion formed intermediate said upper and lower shaft ends, said ledge portion forming a rest for supporting said elongated connecting portion of said missile member on said shaft prior to its toss therefrom.

2. The game apparatus of claim 1, said shaft being of cylindrical cross section and upwardly tapering from a larger diameter lower end to a smaller diameter upper end.

3. The game apparatus of claim 2, said ledge having a radially outwardly generally flat surface for supporting said elongated connecting portion.

4. The game apparatus of claim 3, there being a plurality of elongated connecting portion receiving ledges longitudinally spaced from each other along said shaft.

5. The game apparatus of claim 1, said body elements being generally identical to each other in size, shape and weight.

6. The game apparatus of claim 1, said body elements being spherical balls.

7. The game apparatus of claim 1, at least one of said body elements having a generally flat upper wall portion connected to said cord portion for engagement by said shaft for an alternate tossing mode.

8. The game apparatus of claim 7, said at least one body element being generally of frusto conical shape.

9. The game apparatus of claim 1 including separation means between the grasping portion of said implement and the shaft position thereof in the form of an annular flange.

10. The game apparatus of claim 1, said elongated connecting portion being a cord.

* * * * *